US005933064A

United States Patent [19]

Hilfiker

[11] Patent Number: 5,933,064

[45] Date of Patent: Aug. 3, 1999

[54] ELECTROMAGNETIC CONTACTOR WITH DISPLACEABLE BOBBIN

[75] Inventor: Peter Hilfiker, Buchs, Switzerland

[73] Assignee: Allen-Bradley Company, LLC, Milwaukee, Wis.

[21] Appl. No.: 09/057,989

[22] Filed: Apr. 9, 1998

[30] Foreign Application Priority Data

Oct. 15, 1997 [CH] Switzerland ..... 2403/97

[51] Int. Cl.[6] ..... H01H 67/02

[52] U.S. Cl. ..... 335/132; 335/202

[58] Field of Search ..... 335/132, 202; 200/293–305

[56] References Cited

U.S. PATENT DOCUMENTS

| | | | |
|---|---|---|---|
| 3,238,329 | 3/1966 | Russo | 335/202 |
| 3,643,190 | 2/1972 | Puetz et al. . | |
| 4,951,018 | 8/1990 | Schmiedel et al. | 335/132 |
| 5,600,291 | 2/1997 | Duchemin et al. . | |
| 5,684,442 | 11/1997 | Hufschmid | 335/132 |

FOREIGN PATENT DOCUMENTS

| | | |
|---|---|---|
| 44 06 682 A1 | 3/1994 | Germany . |
| 244459 | 4/1947 | Switzerland . |

*Primary Examiner*—Lincoln Donovan

*Attorney, Agent, or Firm*—David G. Luettgen; John M. Miller; John J. Horn

[57] ABSTRACT

A contactor includes an upper housing (1) for contact parts and a lower bobbin (5) that bears a coil and can be placed therein in an initial position or in a position displaced by 180 degrees. The coil terminals (6, 7) lie next to each other on one side of the bobbin (5). Before the assembly of the bobbin (5) in the housing (1, 4), at least two male parts (2, 3) comprising terminal pins, and at least one female part (8, 9) comprising a hole that is intended to receive one of the male parts (2 or 3), are molded on at the areas that will subsequently border each other. In order to arrange the coil terminals (6, 7) on one side of the contactor, the male part (2 or 3) that does not act in conjunction with a female part (8, 9) in this position must be broken off prior to assembly. In order to arrange the coil terminals (6, 7) on the other side of the contactor that is turned away by 180 degrees, the other male part (2 or 3) must be broken off. Advantageously, in this arrangement the coil terminals always lie unmistakably at the predetermined, accessible side of the uniformly manufactured contactor.

20 Claims, 4 Drawing Sheets

ELECTROMAGNETIC CONTACTOR WITH DISPLACEABLE BOBBIN

BACKGROUND OF THE INVENTION

1. Field of the Invention

The present invention relates to an electromagnetic contactor having a magnetic core fastened inside a housing and acting in conjunction with a movable armature and having a coil wound onto a bobbin and surrounding a leg of the magnetic core. The invention relates especially to a contactor in which coil terminals that are arranged next to each other on one side of the bobbin can lie either on one side or the other side that is displaced by 180 degrees, and in which at least one male part comprising a terminal pin and at least one female part comprising a hole which receives the male part are disposed at the bordering areas of the bobbin and the housing.

2. Description of Related Art

An electromagnetic contactor of the type indicated above is known from U.S. Pat. No. 3,643,190. This contactor features a symmetrically constructed housing into which a magnetic core is fastened. A bobbin that is wound with a coil and ready for emplacement is provided for the middle leg of the magnetic core. The coil has coil terminals which are situated next to each other on one side of the bobbin. Four symmetrically arranged holes serving as female parts are provided in the housing that is provided for support of the bobbin. The bobbin is provided with four terminal pins servings as male parts that are arranged symmetrically with respect to the axis of the bobbin on its side that faces the housing that receives it. The terminal pins serving as male parts fit into the female parts of the housing. Since the housing as well as the support of the bobbin are constructed symmetrically, the bobbin can be assembled in two positions differing by 180 degrees during assembly.

The disadvantage of this arrangement is that the coil terminals may be arranged on both sides of the contactor, independent of the application. This leads to the possibility that, during the assembly of the contactor with an overload relay, the coil terminals may be situated on the side that is difficult to reach, namely, the side of the contactor that faces the overload relay. In this case, the contactor must be opened and the bobbin must be reassembled displaced by 180 degrees. Due to the labeling, the housing should be assembled only in a position that permits reading the labeling, and therefore it should not be possible to displace the housing at will by 180 degrees.

Swiss patent CH-A-244459 also describes a symmetrically constructed bobbin for electromagnetic devices that can also be placed on the magnetic core as desired in an initial position and a position displaced by 180 degrees, as long as the housing that is not specified in this document is also designed correspondingly. This arrangement also exhibits the previously indicated disadvantages.

German Offenlegungsschrift DE-Al 4406682 describes a contactor arrangement wherein the bobbin can only be placed on the magnetic core in one position. The coil terminals that are provided on one side of the bobbin must be on the side of the contactor that faces away and is displaced by 180 degrees. As a result, a different housing and a different bobbin must be produced for the other position, and these differing types must be kept in stock. This, however, results in considerable additional manufacturing and/or warehousing costs.

SUMMARY OF THE INVENTION

A primary object of the invention is to provide a contactor of the initially indicated type, in which the bobbin can only be placed in one unmistakable, initial position that can be determined at the time of manufacture, or in a position displaced by 180 degrees in the housing of the contactor, but which only requires a single, uniformly manufactured housing and a single bobbin.

In accordance with a primary aspect of the invention, the present invention provides an electromagnetic contactor in which, prior to the assembly of the bobbin in the housing, at least two male parts and at least two female parts are provided at the bordering areas of the bobbin and of the housing. At least one of the male parts that does not act in conjunction with a female part when in the desired position must be removed before the assembly of the bobbin, in order to arrange the coil terminals on the one side of the contactor, and at least another male part that does not act in conjunction with a female part in the other selected position must be removed, in order to arrange the coil terminals on the side of the contactor that is turned away by 180 degrees.

Advantageously, for the manufacture of this arrangement, only a single form is required for the bobbin and only a single form is required for the housing. Depending on the terms of supply, the coil leads arranged next to each other at the bobbin are arranged on one side or the other side of the contactor that is displaced by 180 degrees. In order to achieve this, only one male part needs to be attached before the assembly to the bordering areas of the bobbin and of the housing. The break point for the break away male parts are readily visible for purposes of overview on the finally assembled contactor. This solution is economically advantageous in manufacture and is particularly suited for the automatic assembly of the contactor.

Advantageously, each male part is attached to the housing of the fixed and movable contact parts of the contactor and each female part is attached to the bobbin. This solution is particularly advantageous for a housing arrangement, because the male parts can be lodged in recesses and thus do not project from the housing. In this way, an unintentional break off of the male part during manufacture and during assembly can be avoided with certainty.

Before the bobbin is assembled in the housing, two male parts can be provided on the housing that lie in a plane parallel to both sides of the finally assembled contactor that are provided for the coil terminals, and two female parts can be provided that lie in a plane that cuts the plane of the male parts at a male part at a right angle. All male and female parts can then lie on one circle that circumscribes the center axis of the bobbin. This arrangement of the male and/or female parts represents an advantageous, particularly simple arrangement for the electrical contactor.

Every male part can be provided at its root with a predetermined break point. The predetermined break point simplifies the break off of the respective male part.

Other objects, features, and advantages of the present invention will become apparent to those skilled in the art from the following detailed description and accompanying drawings. It should be understood, however, that the detailed description and specific examples, while indicating preferred embodiments of the present invention, are given by way of illustration and not limitation. Many modifications and changes within the scope of the present invention may be made without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENTS

Figure 1:
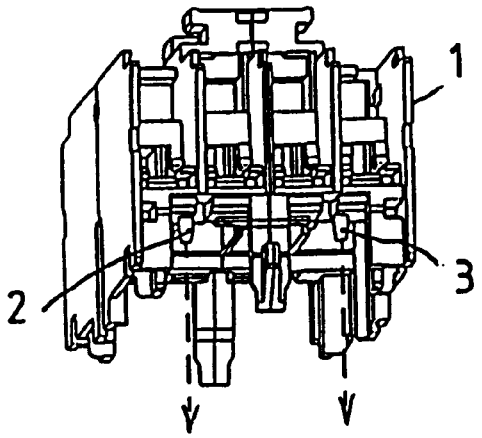
FIG. 1 is a perspective view of an upper subsection of a housing for fixed and moveable contact parts, in which the housing is provided with two male parts in accordance with an embodiment of the present invention.

FIG. 1 illustrates an upper subsection 1 of a housing of fixed and movable contact parts of an electromagnetic contactor. (The term "electromagnetic contactor" includes devices known in some countries as electromagnetic switchgears.) The upper housing subsection 1 has two male parts 2 and 3 comprising terminal pins molded thereon. The male parts 2 and 3 are located such that they are displaced rearward in recesses of the upper housing subsection 1 in order to prevent the unintentional break off of the male part during manufacture and assembly. The upper housing subsection 1 can only be fastened in an unmistakable position to a lower housing subsection 4 as illustrated in FIGS. 4A, 4B, 5A and 5B.

Figure 2:
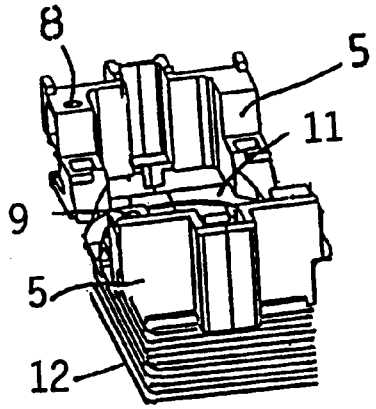
FIG. 2 is a perspective view of a bobbin with a coil wound thereon.
Figure 3:
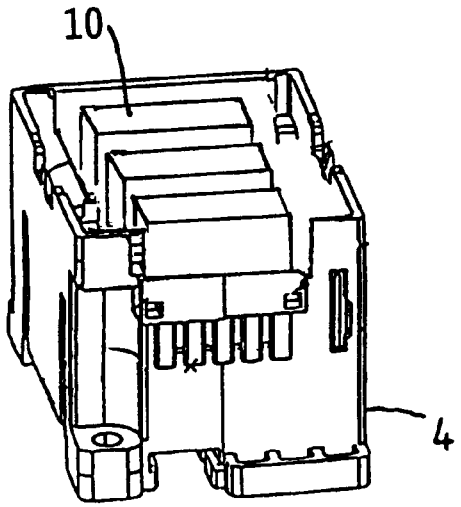
FIG. 3 is a perspective view of a lower subsection of the housing.

A magnetic core 10 that acts in conjunction with a movable armature 11 is located in the lower housing subsection 4. A coil 12 wound on a bobbin 5 is attached around a leg of the magnetic core 10. The coil 12 has coil terminals 6 and 7 which can be seen for example in FIG. 4B. The bobbin 5 features female parts 8 and 9 illustrated for example in FIG. 2, comprising holes, on its side that faces the upper housing subsection 1 of the fixed and movable contact parts.

Figure 4A:
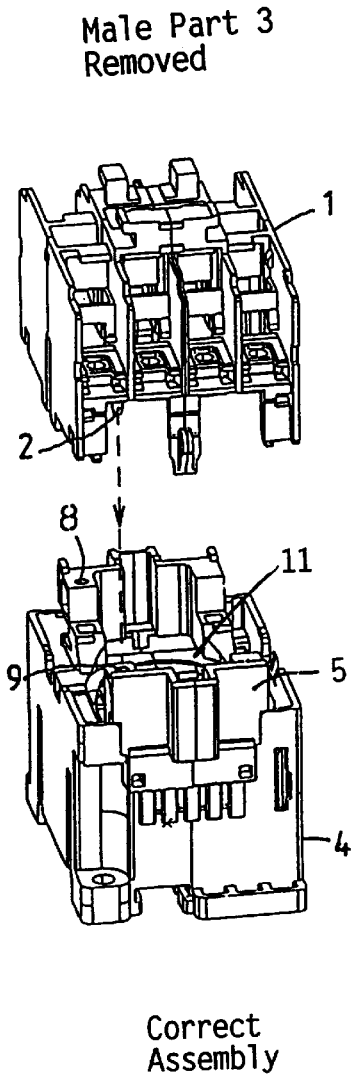
FIG. 4A is a perspective view of the correct assembly of the upper housing subsection and the bobbin, the bobbin being disposed in the lower housing subsection, so that first and second terminals of the coil are disposed at a first location on the contactor.
Figure 4B:
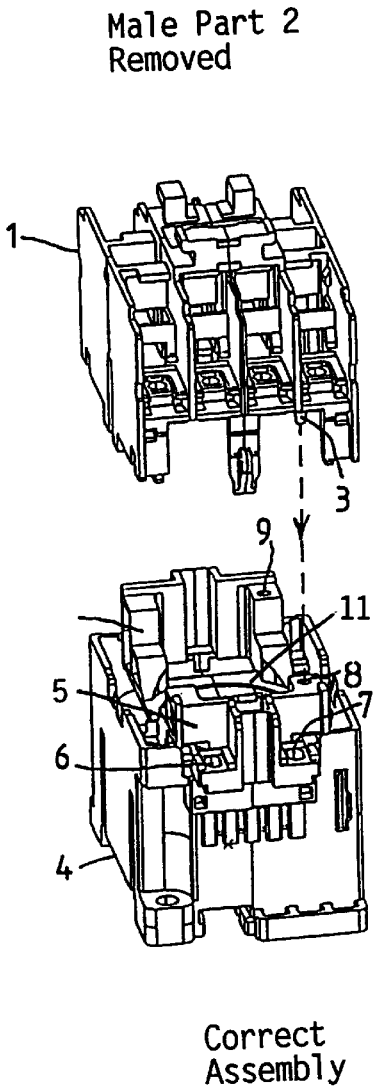
FIG. 4B is a perspective view of the correct assembly of the upper housing subsection and the bobbin, the bobbin being disposed in the lower subsection, so that the first and second terminals of the coil are disposed at a second location on the contactor, the second location being displaced from the first location by 180 degrees.

In FIG. 4A, the male part 2 is received after assembly by the female part 9, and the male part 3 that impedes assembly is removed before the assembly of the bobbin 5 in the assembled housing 1 and 4. In FIG. 4B, the male part 3 is received after assembly by the female part 8 and the male part 2 that impedes assembly is removed.

The lower housing subsection 4 of the magnetic core is symmetrically designed, so that the bobbin 5 can be placed in one position or the other position which is turned away or displaced by 180 degrees. After the point where the upper housing subsection 1 can only be attached to the lower housing subsection 4 in one position, the parts 2 and 9 or the parts 3 and 8 that fit together after assembly determine the side of the contactor on which the coil connection terminals 6 and 7 are positioned.

Figure 5A:
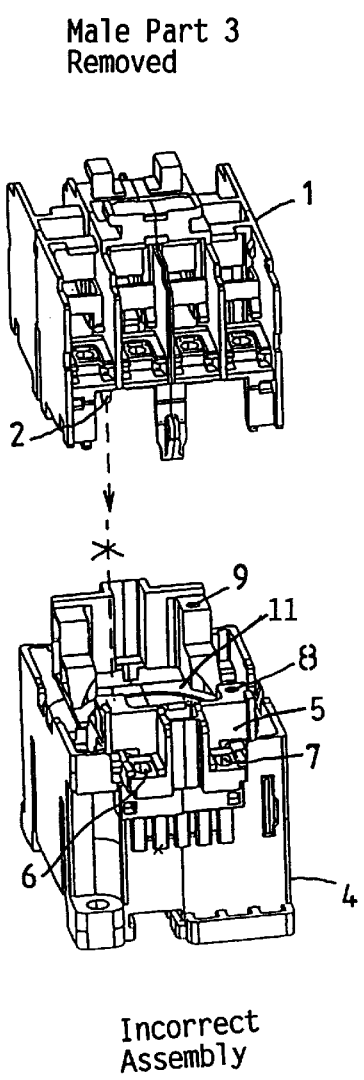
FIGS. 5A and 5B are perspective views of incorrect assembly of the upper housing subsection and the bobbin.
Figure 6B:
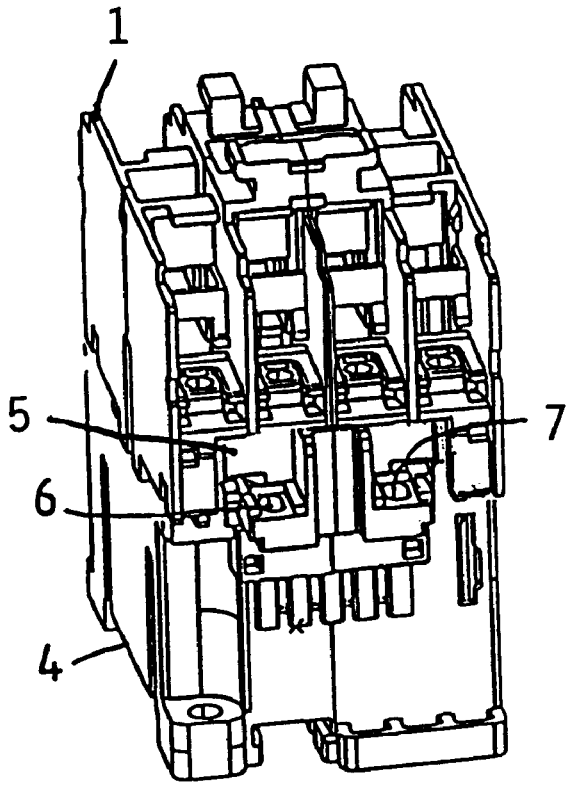
FIG. 6B is a perspective view of the electromagnetic contactor produced by the assembly operation shown in FIG. 4B.
Figure 6A:
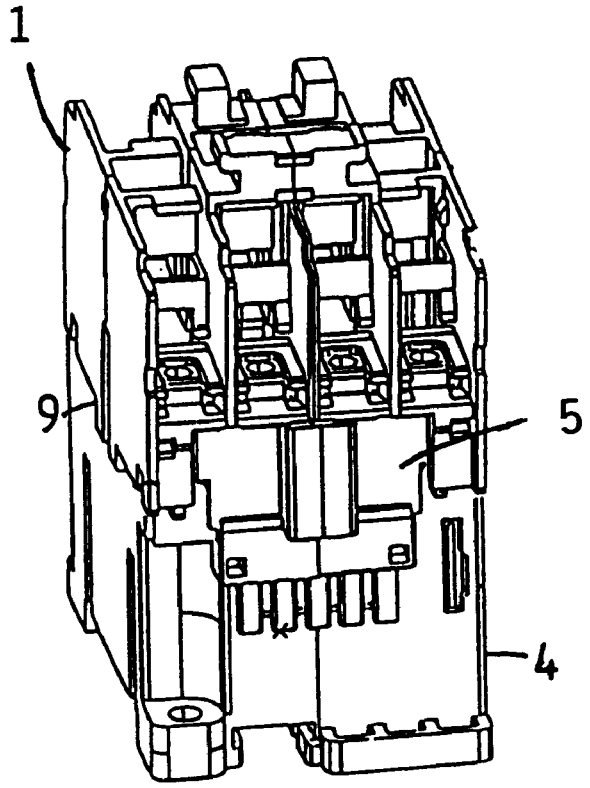
FIG. 6A is a perspective view of an electromagnetic contactor produced as a result of the assembly operation shown in FIG. 4A.

Prior to the assembly of the upper housing subsection 1 with the lower housing subsection 4, there must be a determination, depending on the application of the final contactor, as to whether the coil terminals 6 and 7 are desired at the front or displaced 180 degrees about the center bobbin. If the coil terminals 6 and 7 are to be positioned rearward, the male part 3 is broken off. FIG. 4A illustrates the upper housing subsection 1 with the male part 3 broken off. The coil terminals 6 and 7 are at the rear. In this position, the upper housing subsection 1 can be placed on the bobbin 5 and the contactor can undergo final assembly. The resulting electromagnetic contactor is illustrated in FIG. 6A. In FIG. 5A, the position of the bobbin 5 is displaced by 180 degrees, and the contactor can not undergo final assembly, since the male part 2 is not received by any female part and the assembly is impeded.

Figure 5B:
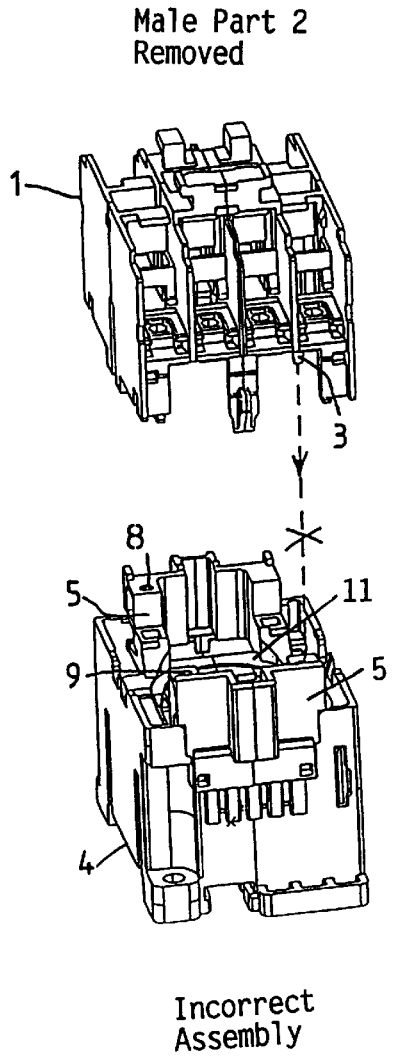

If the coil terminals 6 and 7 are desired at the front, as is illustrated in FIG. 4B, then the male part 2 is broken off. FIG. 4B illustrates the upper housing subsection 1 with the male part 2 broken off. The bobbin 5 is properly positioned for the upper housing subsection 1, with the coil terminals 6 and 7 at the front. In this position, the contactor can undergo final assembly. The resulting electromagnetic contactor is illustrated in FIG. 6B. In FIG. 5B, the position of the bobbin 5 is displaced by 180 degrees and therefore is incorrectly placed, since the male part 3 is not received by any female part. Therefore, assembly of the contactor is impeded.

In order to simplify the break off of the appropriate male part 2 or 3, the male parts 2 and 3 are each provided at their roots with a predetermined break point.

Many other changes and modifications may be made to the present invention without departing from the spirit thereof. The scope of these and other changes will become apparent from the appended claims.

We claim:

1. In combination:

(A) a bobbin;

(B) a movable armature;

(C) a magnetic core, the magnetic core being capable of cooperating with the movable armature to cause the movable armature to move;

(D) a coil, the coil being capable of surrounding a leg of the magnetic core, the coil being wound on the bobbin and having first and second terminals disposed next to each other on one side of the bobbin; and (E) a housing, the housing being capable of containing the bobbin, the magnetic core, the movable armature, and the coil;

(F) a first male part, a second male part, and a female part, the first and second male parts being disposed on one of the housing and the bobbin and the female part being disposed on the other one of the housing and the bobbin;

wherein the bobbin, the movable armature, the magnetic core, the coil, and the housing are capable of being assembled to form an electromagnetic contactor which comprises at least the bobbin, the movable armature, the magnetic core, the coil, and the housing;

wherein the housing and the bobbin are capable of being assembled in first and second configurations which are substantially the same except that, in the second configuration, the bobbin is angularly displaced by approximately 180 degrees about a center bobbin axis as compared to the orientation of the bobbin in the first configuration;

wherein, in the first configuration, the first and second terminals are disposed at a first location on the contactor;

wherein, in the second configuration, the first and second terminals are disposed at a second location on the contactor, the first and second locations being angularly displaced from each other by approximately 180 degrees about the center bobbin axis;

wherein the female part is capable of receiving the second part in the first configuration, and is capable of receiving the first male part in the second configuration;

wherein the first male part obstructs assembly of the housing and the bobbin in the first configuration such that, in order to assemble the housing and the bobbin in the first configuration, the first male part must be removed; and wherein the second male part obstructs assembly of the housing and the bobbin in the second configuration such that, in order to assemble the housing and the bobbin in the second configuration, the second male part must be removed.

2. A combination according to claim 1, wherein the first and second male parts are disposed on the housing and the female part comprises a portion of the bobbin that has a hole formed therein.

3. A combination according to claim 1, wherein the first and second male parts lie in a plane parallel to first and second sides of the housing that are provided for the first and second terminals, and the female part lies in a plane that cuts the plane of the male parts at a male part at a right angle, such that the first and second male parts and the female part all lie on a circle that circumscribes the center axis of the bobbin.

4. A combination according to claim 3, wherein the first and second male parts each have a predetermined break off point.

5. A combination according to claim 1, wherein the housing comprises first and second subsections, the first subsection of the housing being capable of enclosing fixed and movable contact parts of the contactor, and the second subsection of the housing being capable of enclosing the bobbin and the magnetic core; and wherein the first and second male parts are disposed on the housing and the female part comprises a portion of the bobbin that has a hole formed therein.

6. A combination according to claim 1, wherein the housing is formed of first and second subsections, housings, the first subsection of the housing being capable of enclosing fixed and movable contact parts of the contactor, and the second subsection of the housing being capable of enclosing the bobbin and the magnetic core.

7. A combination according to claim 1, wherein the first and second male parts are disposed on the housing, the first and second male parts being disposed in recesses of the housing and not projecting from the housing.

8. A method of manufacturing an electromagnetic contactor, the method comprising the steps of:

(A) providing a housing, a bobbin, and a coil that is wound on the bobbin and that has first and second terminals, the housing and the bobbin being capable of being assembled in first and second configurations, the first and second configurations being substantially the same except that, in the second configuration, the bobbin is angularly displaced about a center bobbin axis as compared to the orientation of the bobbin in the first configuration;

(B) providing one of the housing and the bobbin with first and second male parts, the first male part obstructing assembly of the housing and the bobbin in the first configuration, and the second male part obstructing assembly of the housing and the bobbin in the second configuration;

(C) selectively disposing the first and second terminals at one of first and second locations on the contactor, including (1) breaking off one of the first and second male parts; and (2) assembling the housing and the bobbin to form the contactor, wherein if the first male part is broken off, then the housing and bobbin are assembled in the first configuration and the first and second terminals are disposed at the first location, and wherein if the second male part is broken off, then the housing and the bobbin are assembled in the second configuration and the first and second terminals are disposed at the second location.

9. A method according to claim 8, wherein the one of the first and second male parts is broken off from the housing.

10. A method according to claim 8, wherein the one of the first and second male parts is broken off at a predetermined break off point.

11. A method according to claim 8, wherein the housing is provided in the form of first and second housings, the first housing enclosing fixed and movable contact parts of the contactor, and the second housing enclosing the bobbin and a magnetic core.

12. A method according to claim 8, wherein the one of the first and second male parts is broken off from a location inside a recess of the housing.

13. A method according to claim 8, wherein the first and second locations are angularly displaced from each other by approximately 180 degrees about the center bobbin axis.

14. A method according to claim 8 wherein, during the assembling step, a female part receives the one of the first and second male parts which is not broken off, the female part being a first female part disposed on a first side of the bobbin if the second male part is broken off and the female part being a second female part on a second side of the bobbin if the first male part is broken off.

15. In combination:

(A) a bobbin, the bobbin having disposed on one side thereof first and second terminals which are disposed next to each other;

(B) a housing comprising first and second subsections, the second subsection of the housing being capable of containing the bobbin, the second subsection of the housing being symmetric such that the bobbin may be placed in the second subsection of the housing in either a first position or a second position which is approximately 180 degrees displaced from the first position about a center bobbin axis; and a first male part, a second male part, and a female part, the first and second male parts being disposed on one of first subsection of the housing and the bobbin and the female part being disposed on the other one of the first subsection of the housing and the bobbin;

wherein the housing and the bobbin are capable of being assembled to form an electromagnetic contactor which comprises at least the housing and the bobbin;

wherein the housing and the bobbin are capable of being assembled such that the first and second terminals are disposed at either a first location or a second location on the contactor, the first and second locations being angularly displaced from each other by approximately 180 degrees about a center bobbin axis, the first and second terminals being disposed on the first side of the contactor if the bobbin is in the first position and the first and second terminals being disposed on the second side of the contactor if the bobbin is in the second position;

wherein the female part is capable of receiving the second part in the first configuration, and is capable of receiving the first male part in the second configuration;

wherein the first male part obstructs assembly of the housing and the bobbin in the first configuration such that, in order to assemble the housing and the bobbin in the first configuration, the first male part must be removed; and wherein the second male part obstructs assembly of the housing and the bobbin in the second configuration such that, in order to assemble the housing and the bobbin in the second configuration, the second male part must be removed.

16. A combination according to claim 15, wherein the first and second male parts are disposed on the first housing and the female part comprises a portion of the bobbin that has a hole formed therein.

17. A combination according to claim 15, wherein the first and second male parts and the female part all lie on a circle that circumscribes the center axis of the bobbin.

18. A combination according to claim 15, wherein the first and second male parts have a predetermined break off point.

19. A combination according to claim 15, wherein the first and second male parts are disposed on the first subsection of the housing and in recesses of the first subsection of the housing so as not to project from the first subsection of the housing.

20. A combination according to claim 1, wherein the female part comprises first and second female parts.

* * * * *